US008721303B2

(12) United States Patent
Fujisaki et al.

(10) Patent No.: US 8,721,303 B2
(45) Date of Patent: May 13, 2014

(54) PIEZOELECTRIC MICRO-BLOWER

(75) Inventors: Masaaki Fujisaki, Nagaokakyo (JP); Atsuhiko Hirata, Nagaokakyo (JP); Kiyoshi Kurihara, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 138 days.

(21) Appl. No.: 13/423,342

(22) Filed: Mar. 19, 2012

(65) Prior Publication Data

US 2013/0071269 A1 Mar. 21, 2013

Related U.S. Application Data

(63) Continuation of application No. PCT/JP2010/066521, filed on Sep. 24, 2010.

(30) Foreign Application Priority Data

Oct. 1, 2009 (JP) ..... 2009-229195

(51) Int. Cl.
*F04B 17/00* (2006.01)
*H01L 41/047* (2006.01)

(52) U.S. Cl.
USPC ..... 417/413.2

(58) Field of Classification Search
USPC ..... 417/413.2, 410.2, 413.1; 977/733, 724; 310/365, 366, 328
See application file for complete search history.

(56) References Cited

U.S. PATENT DOCUMENTS

| | | | | |
|---|---|---|---|---|
| 7,553,135 | B2 * | 6/2009 | Cho et al. | 417/413.2 |
| 2006/0201327 | A1 | 9/2006 | Janse Van Rensburg et al. | |
| 2008/0170951 | A1 * | 7/2008 | Satoh | 417/413.2 |
| 2009/0167109 | A1 * | 7/2009 | Tomita et al. | 310/317 |
| 2009/0232682 | A1 | 9/2009 | Hirata et al. | |

FOREIGN PATENT DOCUMENTS

| | | | |
|---|---|---|---|
| EP | 1 515 043 | A1 | 3/2005 |
| JP | 2005-090510 | A | 4/2005 |
| JP | 2006-522896 | A | 10/2006 |
| JP | 2009-103111 | A | 5/2009 |
| WO | 2008/069266 | A1 | 6/2008 |

OTHER PUBLICATIONS

Official Communication issued in International Patent Application No. PCT/JP2010/066521, mailed on Dec. 21, 2010.

* cited by examiner

*Primary Examiner* — Bryan Lettman
(74) *Attorney, Agent, or Firm* — Keating & Bennett, LLP

(57) ABSTRACT

A piezoelectric micro-blower includes a blower chamber located between a blower body and a vibrating plate, a first wall portion of the blower body arranged to face the vibrating plate across the blower chamber so as to vibrate with vibrations of the vibrating plate, a first opening in the first wall portion, a second wall portion on the opposite side of the first wall portion with respect to the blower chamber, a second opening in a portion of the second wall portion which faces the first opening, and an inflow passage located between the first wall portion and the second wall portion. Each of the first and second openings includes a plurality of holes, and each hole of the first opening and each hole of the second opening are arranged to face each other. Thus, noise is significantly reduced while the flow characteristic is maintained.

4 Claims, 8 Drawing Sheets

COMPARATIVE EXAMPLE 1

COMPARATIVE EXAMPLE 2

P-Q CHARACTERISTIC

PIEZOELECTRIC MICRO-BLOWER

BACKGROUND OF THE INVENTION

1. Field of the Invention

The present invention relates to a piezoelectric micro-blower suitable for conveying compressible fluid such as air and gas.

2. Description of the Related Art

A piezoelectric micro-blower is known as an air blower for dissipating heat generated in a housing of a portable electronic apparatus or for supplying oxygen required to generate electric power in a fuel cell. The piezoelectric micro-blower is a type of pump which includes a diaphragm which bends when a voltage is applied to a piezoelectric element, and is advantageous in that the piezoelectric micro-blower can be configured to have a simple structure, small size and thickness, and low power consumption.

Japanese Unexamined Patent Application Publication No. 64-2793 (FIG. 14) discloses a flow generating apparatus including a piezoelectric element. In the flow generating apparatus, as shown in FIG. 14, a compression chamber 103 is formed between a base 100 and a nozzle plate 101, a ring-shaped piezoelectric element 104 is fixed to the nozzle plate 101, and a plurality of nozzle holes 102 is formed in the central portion of the nozzle plate 101. A case 105 is provided so as to surround the base 100 at a predetermined interval, and a cylindrical guide 106 is formed at a portion of the case 105 which faces the nozzle holes 102. By driving the piezoelectric element 104 at a high frequency, the nozzle plate 101 is flexurally vibrated, a jet flow is generated from the plurality of nozzle holes 102, and the airflow discharged from the nozzle holes 102 can be discharged from the guide 106 of the case 105 to the outside while drawing the ambient air.

In Japanese Unexamined Patent Application Publication No. 64-2793, by driving the piezoelectric element 104, the central portion of the nozzle plate 101 greatly flexurally vibrates and a jet flow can be generated in accordance with the displacement of the nozzle plate 101. However, the wall portion of the base 100 which faces the nozzle plate 101 across the compression chamber 103 is a fixed wall, and thus, a significant increase in flow rate cannot be expected only by the vibrations of the nozzle plate 101.

Japanese Unexamined Patent Application Publication No. 2006-522896 discloses a gas flow generator. As shown in FIG. 15, the gas flow generator includes an ultrasonic driver 110 in which a ring-shaped piezoelectric element 112 is fixed on a ring-shaped base 111, a first stainless-steel membrane 113 fixed to a lower surface of the driver 110, a second stainless-steel membrane 114 mounted parallel to and at a predetermined interval from the first membrane 113, and a spacer 116 retaining the membranes 113 and 114 such that the membranes 113 and 114 are spaced apart from each other. The central portion of the first membrane 113 bulges downwardly, and the second membrane 114 has a plurality of holes 115 formed in the central portion thereof.

In the case of the gas flow generator, when the ultrasonic driver 110 is driven at a high frequency, air is discharged in the orthogonal direction of the holes 115 while the air around the holes 115 formed in the central portion of the second membrane 114 is sucked or drawn, whereby an inertial jet can be generated. However, the space around the holes 115 in the second membrane 114 is an opened space, and thus the discharged airflow diffuses and a desired flow rate cannot be obtained. In addition, a vortex of air occurs around the holes 115 and great noise occurs.

Thus, the applicant of the present application has proposed a piezoelectric micro-blower having high pressure and flow rate (International Publication No. WO2008/69266). As shown in FIG. 16, the micro-blower includes a blower body 120, a vibrating plate 121 which is fixed at an outer peripheral portion thereof to the blower body 120 and includes a piezoelectric element 122, and a blower chamber 123 formed between the blower body 120 and the vibrating plate 121. A first wall portion 124 is provided at a location facing the vibrating plate 121 across the blower chamber 123 and resonates with vibrations of the vibrating plate 121. The first wall portion 124 has a first opening portion 125 formed in the central portion thereof. A second wall portion 126 is provided on the opposite side of the first wall portion 124 with respect to the blower chamber 123. The second wall portion 126 has a second opening portion 127 formed in a portion thereof facing the first opening portion 125. An inflow passage 129 is formed between the first wall portion 124 and the second wall portion 126 and communicates with inlets 128. When the vibrating plate 121 vibrates, fluid is ejected from the first opening portion 125 due to a change in volume of the blower chamber 123, and can be discharged from the second opening 127 to the outside while drawing the ambient fluid in the inflow passage 129.

In the piezoelectric micro-blower, when the vibrating plate 121 is vibrated, fluid is sucked through the first opening 125 in a first half cycle and then is discharged in the next half cycle. However, because the fluid is discharged from the second opening 127 while the ambient air is drawn by a high-speed airflow discharged from the first opening 125, a discharge flow rate larger than the displaced volume of the vibrating plate 121 can be obtained at the second opening 127. In addition, when the first wall portion 124 is resonated with vibrations of the vibrating plate 121, the displaced volume of the vibrating plate 121 is increased by displacement of the first wall portion 124, whereby high pressure and flow rate can be obtained. Such a superior effect is provided but great noise (e.g., wind noise) occurs near the first opening 125.

SUMMARY OF THE INVENTION

Therefore, preferred embodiments of the present invention provide a piezoelectric micro-blower having low noise while maintaining a sufficient flow rate.

A preferred embodiment of the present invention provides a piezoelectric micro-blower including a blower body; a vibrating plate fixed at an outer peripheral portion thereof to the blower body and including a piezoelectric element; a blower chamber located between the blower body and the vibrating plate; a first wall portion of the blower body provided at a location facing the vibrating plate across the blower chamber to vibrate with vibrations of the vibrating plate; a first opening located in the first wall portion; a second wall portion provided on an opposite side of the first wall portion with respect to the blower chamber; a second opening located in a portion of the second wall portion which faces the first opening; and an inflow passage located between the first wall portion and the second wall portion. Each of the first opening and the second opening includes a plurality of holes, and each hole of the first opening and each hole of the second opening are provided in positions facing each other.

FIG. 13A shows a flow of an airflow and a speed distribution in an apparatus disclosed in International Publication No. WO2008/69266, and FIG. 13B shows a flow of an airflow and a speed distribution in an example of a preferred embodiment of the present invention. The speed distributions are indicated by thin lines. 200 is a first wall portion, 210 is a second wall portion, 201 and 202 are first openings, and 211 and 212 are second openings. As shown in FIG. 13A, one first opening 201 is formed in the central portion of the first wall portion 200 where the vibration amplitude of the first wall portion 200 is at its maximum, and hence a high-speed airflow 220 having a high speed peak at the center of the first opening 201 occurs. The high-speed airflow 220 flowing in the center has, for example, a speed of 100 m/s. Thus, the fact that a great difference in speed distribution occurs between directly above the first opening 201 and the surrounding thereof and the high-speed airflow 220 interferes with the second opening 211 is thought as a cause of occurrence of great noise (wind noise) near the first opening 201 and the second opening 220.

On the other hand, in an example of a preferred embodiment of the present invention, as shown in FIG. 13B, an airflow 221 generated at each of a plurality of first openings 202 is immediately mixed with the ambient air to reduce the speed difference from the ambient air, and hence the speed peak is relatively small and dispersed. Thus, it is thought that the flow speed difference between each first opening 202 and the ambient region thereof, and the flow speed of the high-speed airflow 221 which interferes with each second opening 212 can be reduced and hence the noise can be reduced near the first openings 202 and the second openings 212. It is thought that the magnitude of the noise is proportional to the fourth to eighth power of the flow speed, and hence the sound pressure level of the noise can be significantly reduced. In addition, as another advantageous effect, a region drawn by the fluid near the first openings 202 is increased in the case where a plurality of first openings is provided, more than in the case where a single first opening is provided, and thus the flow rate increases. This comparison is made based on the assumption that the cross-sectional area in the case where a single first opening is provided and the total cross-sectional area in the case where a plurality of first openings is provided are the same.

When the first opening is composed of multiple holes and the second opening is composed of a single hole (see, for example, Japanese Unexamined Patent Application Publication No. 64-2793), the second opening has to be sized so as to include all of the first opening, in order to reduce the fluid resistance. However, in this case, the air outside the second opening may flow back toward the first opening depending on the pressure difference between inside and outside the second opening and the air-flow resistance of the second opening, and there is the possibility that the discharge flow rate decreases. On the other hand, in a preferred embodiment of the present invention, each hole of the second opening 212 and each hole of the first opening 202 are arranged so as to face each other. Thus, backflow near the second opening 212 can be prevented, and the flow characteristic can be maintained.

A central axis of each hole of the first opening and a central axis of each hole of the second opening desirably coincide with each other. The central axis of each hole of the second opening does not have to completely coincide with the central axis of each hole of the first opening. However, when the central axis of each hole of the second opening coincides with the central axis of each hole of the first opening, the airflow discharged from each first opening can linearly pass through the second opening. Thus, the fluid resistance can be reduced and the flow characteristic can be improved.

A diameter d2 of each hole of the second opening is preferably about one to about three times that of a diameter dl of each hole of the first opening. The second opening and the first opening may have the same diameter, for example. However, when the second opening and the first opening have the same diameter, there is the possibility that an airflow generated at the first opening collides with the periphery of the second opening to increase the flow path resistance. On the other hand, when the second opening is too large, there is the possibility that backflow occurs near the second opening. Thus, by setting the diameter d2 of each hole of the second opening to about one to about three times that of the diameter d1 of each hole of the first opening, backflow can be prevented while the flow path resistance in the second opening is reduced, and a high flow rate is obtained.

As described above, according to the piezoelectric micro-blower according to various preferred embodiments of the present invention, since each of the first opening and the second opening includes a plurality of holes and the first opening and the second opening are arranged so as to overlap each other in the facing direction, the speed peak of the airflow generated at each of the plurality of first openings is dispersed, the speed difference between each first opening and the surrounding region of each first opening can be reduced, and the noise near the first opening and the second opening can be reduced. In addition, since the second opening including a plurality of holes facing the first opening, backflow near the second opening can be prevented, and the characteristic of flow rate can be maintained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
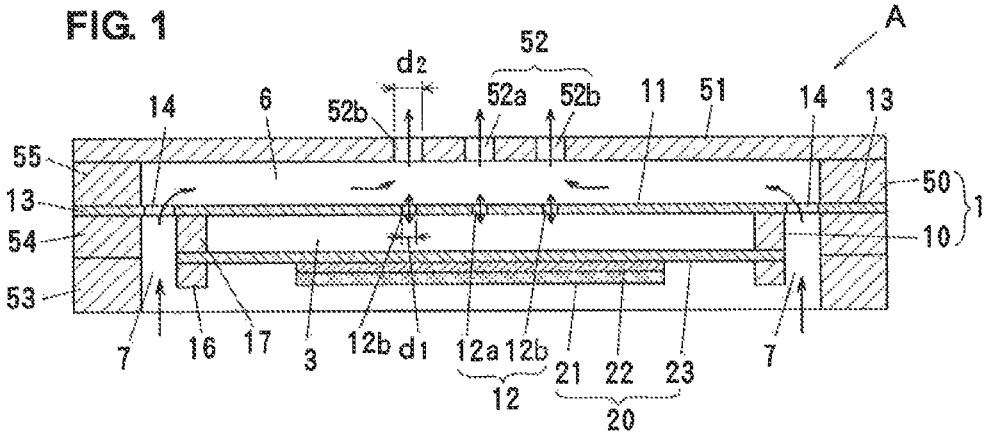
FIG. 1 is a cross-sectional view of a piezoelectric micro-blower according to a first preferred embodiment of the present invention.

FIGS. 1 to 4 show a first preferred embodiment of a piezoelectric micro-blower according to the present invention. A blower body 1 of the piezoelectric micro-blower A preferably includes an inner case 10 and an outer case 50 which covers an outside portion of the inner case 10 in a non-contact manner at a predetermined interval, and the inner case 10 and the outer case 50 are connected to each other via a plurality of spring connection portions 15. In this preferred embodiment, the inner case 10 has a structure such that a cross-sectional shape thereof is a U shape whose lower portion is opened, a vibrating plate 20 is fixed so as to close the lower opening of the inner case 10, and a blower chamber 3 is located between the inner case 10 and the vibrating plate 20. The vibrating plate 20 in this preferred embodiment preferably has a unimorph structure in which a piezoelectric element 21 made of piezoelectric ceramic and an intermediate plate 22 made of a metal thin plate are attached to the central portion of a diaphragm 23 made of a metal thin plate. When a voltage of a predetermined frequency is applied to the piezoelectric element 21, the entire vibrating plate 20 is driven to resonate in a bending mode.

The vibrating plate 20 is not limited to the unimorph type described above, and may be a bimorph type in which piezoelectric elements 21 are attached to both surfaces of the diaphragm 23 and expand and contract in the opposite directions, a bimorph type in which a laminated piezoelectric element which bends is attached to one side surface of a diaphragm, or one in which a diaphragm includes a laminated piezoelectric element. In addition, the shape of the piezoelectric element 21 is not limited to the disc shape and may be a rectangular shape or an annular shape, for example. A structure may be provided in which the intermediate plate 22 is omitted and the piezoelectric element 21 is directly attached to the diaphragm 23. In either case, the vibrating plate suffices to flexurally vibrate when an alternating voltage (or a rectangular-wave voltage) is applied to the piezoelectric element 21.

Figure 3:
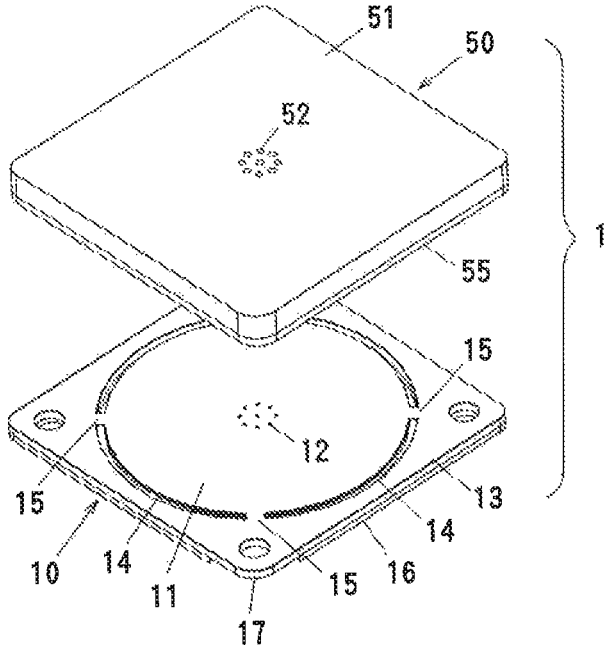
FIG. 3 is an exploded perspective view when the piezoelectric micro-blower shown in FIG. 1 is viewed from a second wall portion side.
Figure 4:
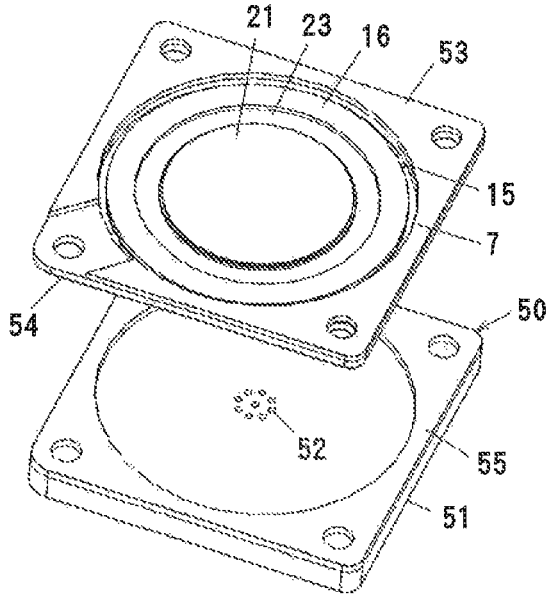
FIG. 4 is an exploded perspective view when the piezoelectric micro-blower shown in FIG. 1 is viewed from a vibrating plate side.

As shown in FIG. 1, in the central portion of a top plate (first wall portion) 11 of the inner case 10 which faces the central portion of the vibrating plate 20 across the blower chamber 3, a first opening 12 is provided and includes a plurality of holes 12*a* and 12*b*. The top plate 11 of the inner case 10 is preferably defined by a metal plate which is thin so as to resonate with resonant driving of the vibrating plate 20. An outer peripheral portion 13 of the top plate 11 protrudes in the radial direction and fixed by the outer case 50. As shown in FIG. 3, a plurality of (for example, four in this case) spring connection portions 15 are located between the top plate 11 of the inner case 10 and the outer case 50 and separated from each other by arc-shaped slits 14. The inner case 10 is elastically supported to the outer case 50 due to these spring connection portions 15. When the inner case 10 vibrates vertically with resonant driving of the vibrating plate 20, the spring connection portions 15 prevent leaks of the vibrations to the outer case 50. The inner case 10 in this preferred embodiment is obtained by stacking and bonding a first inner frame 16, the diaphragm 23, a second inner frame 17, and the top plate 11 in order from below.

Figure 2:
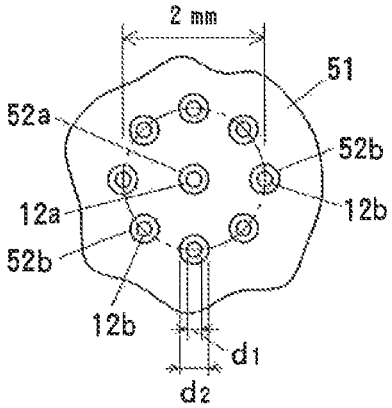
FIG. 2 is a partial plan view when the piezoelectric micro-blower shown in FIG. 1 is viewed from a discharge side.

In the central portion of a top plate (second wall portion) 51 of the outer case 50 which faces the top plate 11 of the inner case 10, a second opening 52 is provided and includes a plurality of holes 52*a* and 52*b* which face the holes 12*a* and 12*b*, respectively, of the first opening 12. In this preferred embodiment, the central axis of each of the holes 12*a* and 12*b* of the first opening 12 and the central axis of each of the holes 52*a* and 52*b* of the second opening 52 are aligned in a straight line, and the diameter d2 of each hole of the second opening 52 is larger than the diameter d1 of each hole of the first opening 12. In this preferred embodiment, as shown in FIG. 2, each of the first opening 12 and the second opening 52 includes, for example, nine circular holes including one hole (12*a*, 52*a*) at the center and eight holes (12*b*, 52*b*) arranged around the center in a ring, but is not limited thereto. The outer case 50 in the this preferred embodiment is preferably obtained by stacking and bonding a first outer frame 53, a second outer frame 54, the top plate 11 of the inner case 10, a third outer frame 55, and the top plate 51 in order from below.

The vibrating plate 20 is desirably driven in a first-order resonance mode, since the largest displacement amount is obtained. However, the first resonant frequency is in the human audible range, and noise may be great. In contrast, when the vibrating plate 20 is driven in a third-order resonance mode, the displacement amount is reduced as compared to that in the first-order resonance mode, but the vibrating plate 20 can be driven at a frequency beyond the audible range and thus noise can be prevented. The vibrating plate 20 and the top plate (first wall portion) 11 may be vibrated in the same vibration mode or may be vibrated in different vibration modes (e.g., one in the first-order resonance mode and the other in the third-order resonance mode). It should be noted that the first-order resonance mode refers to a mode in which a loop appears in the vibrating plate 20 or the top plate 11, and the third-order resonance mode refers to a mode in which a loop occurs at each of the central portion of the vibrating plate 20 or the top plate 11 and its peripheral portion.

A center space 6 is provided between the top plate 11 and the top plate 51 and communicates with the first opening 12 and the second opening 52. The center space 6 is connected via the slits 14 to an annular inlet 7 provided in a gap between the inner case 10 and the outer case 50. Thus, when flow of air occurs in the direction of arrows in the first opening 12 by driving of the vibrating plate 20, the outside air is sucked through the inlet 7, moved through the slits 14 and the center space 6, and discharged from the second opening 52.

Here, the operation of the piezoelectric micro-blower A having the configuration described above will be described. When an alternating voltage of a predetermined frequency is applied to the piezoelectric element 21, the vibrating plate 20 is driven to resonate in the first-order resonance mode or the third-order resonance mode, and thus the distance between the first opening 12 and the vibrating plate 20 changes. In a case in which the distance between the first opening 12 and the vibrating plate 20 increases, the air in the center space 6 is sucked into the blower chamber 3 through the first opening 12. On the other hand, in the case the distance between the first opening 12 and the vibrating plate 20 decreases, the air in the blower chamber 3 is discharged to the center space 6 through the first opening 12. Since the vibrating plate 20 is driven at a high frequency, a high-speed and high-energy airflow discharged from the first opening 12 to the center space 6 passes through the center space 6 and is discharged from the second opening 52. At that time, the airflow is discharged from the second opening 52 while drawing the air present in the center space 6. Thus, a continuous flow of air from the inlet 7 toward the center space 6 occurs and the air is continuously discharged from the second opening 52 as a jet flow. The flow of air is shown by arrows in FIG. 1.

Since the top plate 11 of the inner case 10 is preferably sufficiently thin such that the top plate 11 resonates with resonant driving of the vibrating plate 20, the distance between the first opening 12 and the vibrating plate 20 changes in synchronization with vibrations of the vibrating plate 20. Thus, as compared to the case where the top plate 11 does not resonate, the flow rate of the air discharged from the second opening 52 significantly increase. In a case in which the entirety of the top plate 11 is sufficiently thin as shown in FIG. 1, the entirety of the top plate 11 can be resonated, and thus the flow rate can be increased further. The top plate 11 may resonate in either the first-order resonance mode or the third-order resonance mode.

Figure 5A:
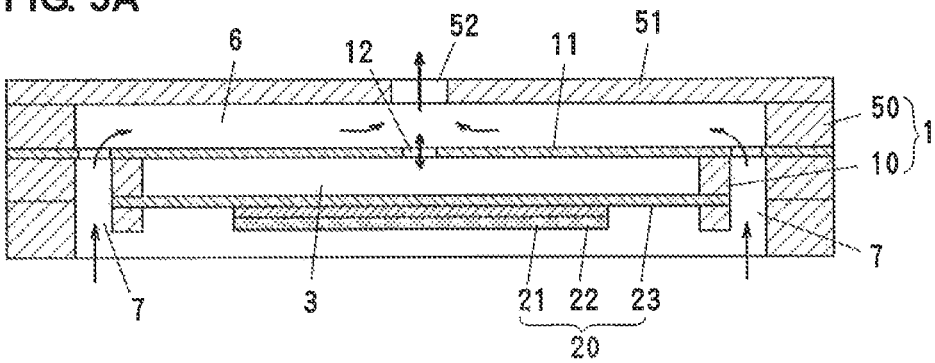
FIGS. 5A and 5B are cross-sectional views of a comparative example 1 and a comparative example 2.
Figure 5B:
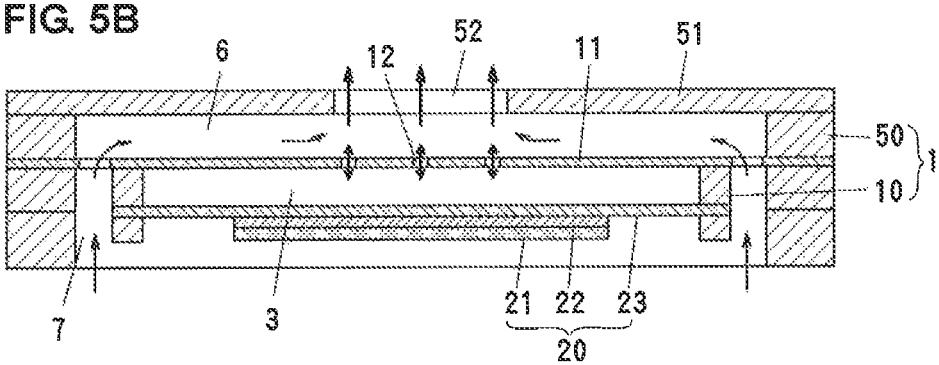

The advantageous effects provided by each of the first opening 12 and the second opening 52 preferably including nine holes each (see FIG. 2) will be described below in contrast to comparative examples 1 and 2. FIG. 5A shows the comparative example 1 in which each of the first opening 12 and the second opening 52 in the piezoelectric micro-blower A of the first preferred embodiment is composed of a single hole similarly to International Publication No. WO2008/69266. FIG. 5B shows the comparative example 2 in which the first opening 12 is composed of a plurality of holes and the second opening 52 is composed of a single hole. When the first opening 12 has a multi-hole structure and the second opening 52 is composed of a single hole as in the comparative example 2, the second opening 52 is sized to be able to include the entire first opening 12. Here, each dimension is as follows. The cross-sectional area in the case where the first opening is composed of a single hole and the total cross-sectional area in the case where the first opening is composed of a plurality of holes are set so as to be the same.

An explanation of the characteristics of a non-limiting example of the first preferred embodiment of the present invention and of comparative examples 1 and 2 is described below.

First Preferred Embodiment

Piezoelectric substance 21: PZT having a thickness of 0.15 mm and a diameter of ϕ 11 mm.

Intermediate plate 22: SUS430 having a thickness of 0.2 mm and a diameter of ϕ 11 mm.

Diaphragm 23: 42Ni having a thickness of 0.05 mm and a diameter of ϕ 17 mm.

Top plate 11: SUS430 having a thickness of 0.1 mm.

Blower chamber 3: SUS430 having a thickness of 0.15 mm and a diameter of ϕ14 mm.

Spring connection portions 15: a length of 0.5 mm and a width of 1 mm.

Inlet 7: a width of 0.5 mm.

Outer case 50: a thickness of 3.0 mm, 20 mm×20 mm.

First opening 12: ϕ 0.2 mm×nine holes, hole distribution diameter=ϕ 2 mm.

Second opening 52: ϕ 0.4 mm×nine holes.

Driving voltage: 15 Vp-p

Driving frequency: 25 kHz (vibrating plate 20 and top plate 11 resonate in third-order resonance)

COMPARATIVE EXAMPLE 1

First opening: ϕ 0.6 mm

Second opening: ϕ 0.8 mm

COMPARATIVE EXAMPLE 2

First opening: ϕ 0.2 mm×nine holes, hole distribution diameter=ϕ 2 mm.

Second opening: ϕ 2.4 mm

Figure 6:
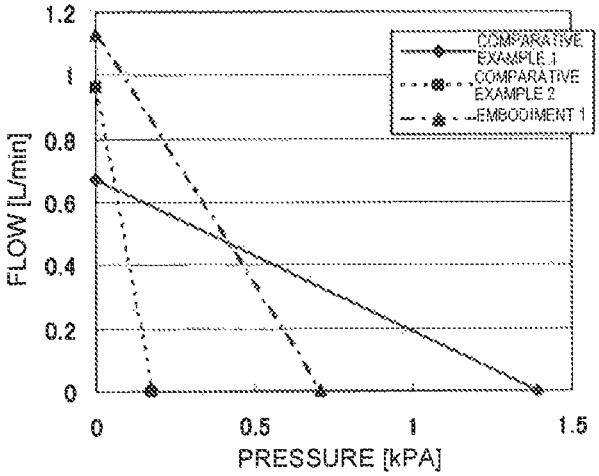
FIG. 6 is a P-Q characteristic diagram of the first preferred embodiment and the comparative examples 1 and 2.
Figure 7:
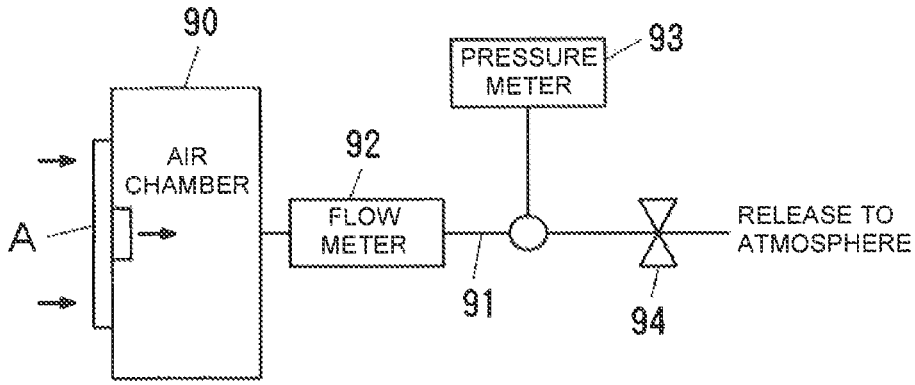
FIG. 7 is a schematic diagram of a measuring apparatus for measuring a P-Q characteristic.

FIG. 6 shows each of P-Q (pressure-flow rate) characteristics of the first preferred embodiment of the present invention, the comparative example 1, and the comparative example 2. For the P-Q characteristic, as shown in FIG. 7, the micro-blower A is fixed to a side wall of an air chamber 90 so as to send the outside air into the air chamber 90, the rate of flow in a pipe 91 connected to the opposite-side side wall of the air chamber 90 is measured with a flow meter 92, and the pressure is measured with a pressure meter 93. An end of the pipe 91 is released to the atmosphere via a valve 94. The valve 94 is opened at flow rate measurement, and is closed at pressure measurement.

As is clear from FIG. 6, in the first preferred embodiment, as compared to the comparative example 1, the pressure decreases to about half but the flow rate increases by about 1.7 times, for example. In addition, it appears that as compared to the comparative example 2, the pressure increases by about 3.5 times and the flow rate increases by about 1.2 times. As described above, the first preferred embodiment is effective for application in which a high flow rate is required.

Figure 8:
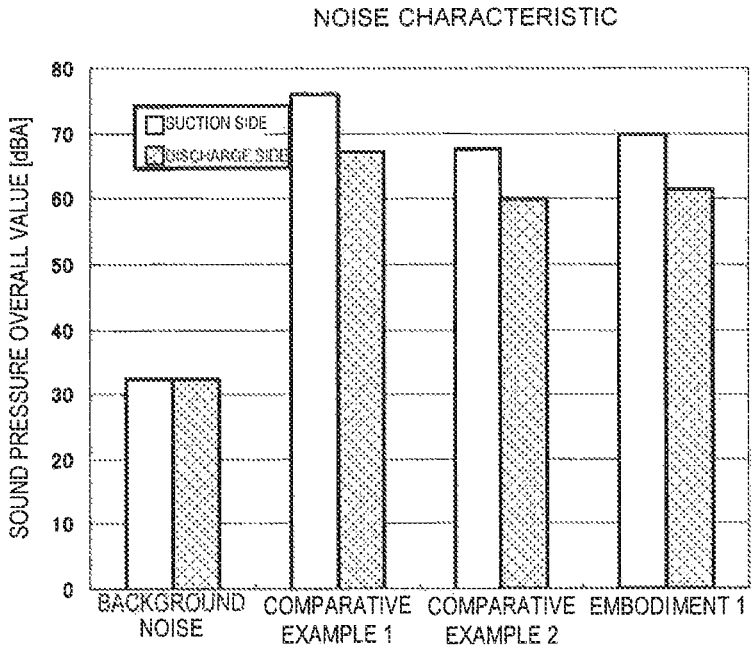
FIG. 8 is a diagram showing noise characteristics of the first preferred embodiment and the comparative examples 1 and 2.

FIG. 8 shows noise characteristics of the first preferred embodiment of the present invention, the comparative example 1, and the comparative example 2. Here, a microphone is installed at a distance of about 30 mm from each of the suction side and the discharge side of the micro-blower, and the sound pressure is measured on each of the suction side and the discharge side. The sound pressure measuring conditions are as follows. The background noise indicates noise when the blower is not driven.

Sound pressure measuring time: 10 [s]

Sampling frequency: 51.2 kHz

Analysis method: FFT analysis is conducted and an overall value is calculated.

Filter at FFT analysis: A characteristic

Averaging: simple averaging of measurement data for 10 seconds.

Overlap value: 90%

As is seen from FIG. 8, in the first preferred embodiment, as compared to the comparative example 1, the noise decreases on the suction side by about 6.2 dB and on the discharge side by about 5.6 dB. As compared to the comparative example 2, the noise increases on the suction side by about 2.2 dB and on the discharge side by about 1.6 dB. The sound pressure has about 1.4 times difference at about 3 dB and about 2 times difference at about 6 dB, for example. Thus, in the first preferred embodiment, the sound pressure of the noise can be reduced to about half as compared to the comparative example 1. It should be noted that in the first preferred embodiment, as compared to the comparative example 2, the sound pressure is slightly high but there is a great difference in P-Q characteristic (see FIG. 6). Thus, when the noise characteristic and the P-Q characteristic are taken into consideration in a comprehensive manner, it appears that the first preferred embodiment has favorable characteristics.

As described above, the first preferred embodiment achieves the following advantageous effects.

By the first opening including multiple holes, a jet flow of air discharged from the first opening is immediately mixed with the ambient air to reduce the flow speed, and thus noise is reduced. In addition, due to the mixing, the drawn amount of the ambient air increases and the maximum flow rate can be increased.

By the second opening including multiple holes, the total cross-sectional area of the second opening is reduced, flow of air flowing back from the blower discharge side is prevented and suppressed, and increase in flow rate can be achieved.

Second Preferred Embodiment

Figure 9:
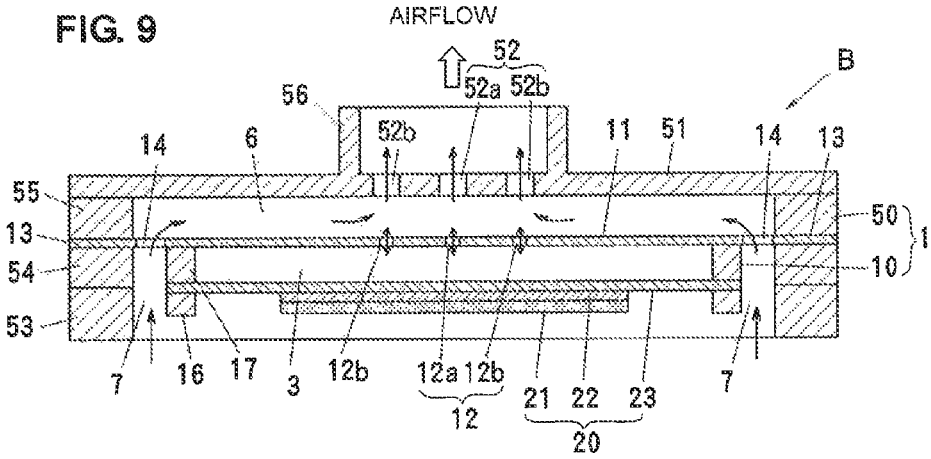
FIG. 9 is a cross-sectional view of a piezoelectric micro-blower according to a second preferred embodiment of the present invention.
Figure 13A:
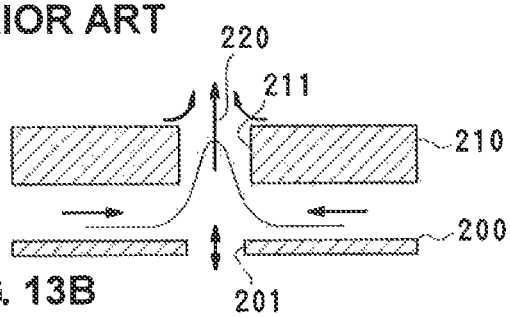
FIG. 13A PRIOR ART
FIGS. 13A and 13B are diagrams showing flows of airflows and speed distributions in an existing structure and in an example of a preferred embodiment of the present invention, respectively.
Figure 13B:
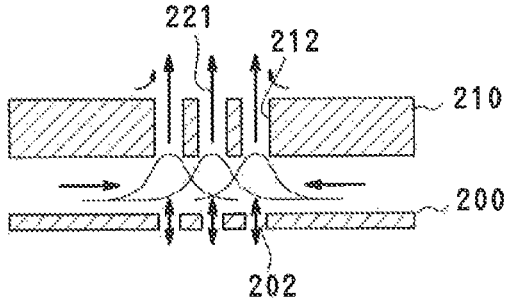
Figure 14:
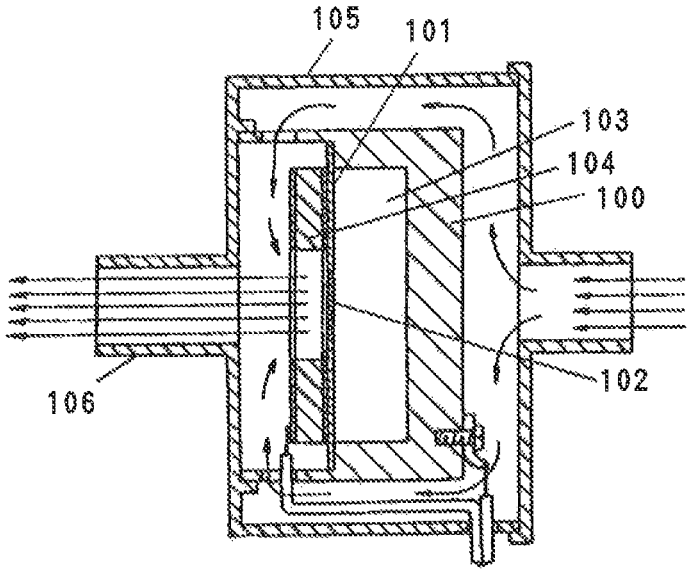
FIG. 14 PRIOR ART
FIG. 14 is a cross-sectional view of a flow generating apparatus in Japanese Unexamined Patent Application Publication No. 64-2793.
Figure 15:
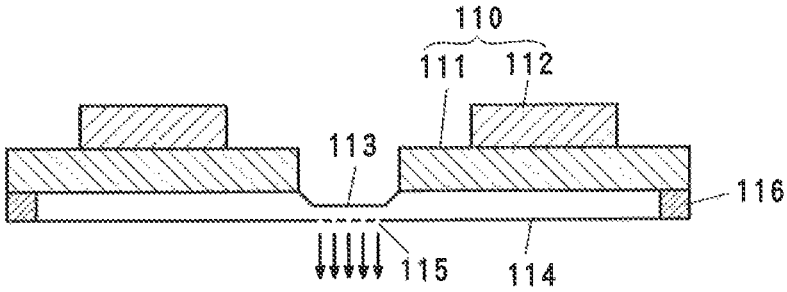
FIG. 15 PRIOR ART
FIG. 15 is a cross-sectional view of a gas flow generator in Japanese Unexamined Patent Application Publication No. 2006-522896.
Figure 16:
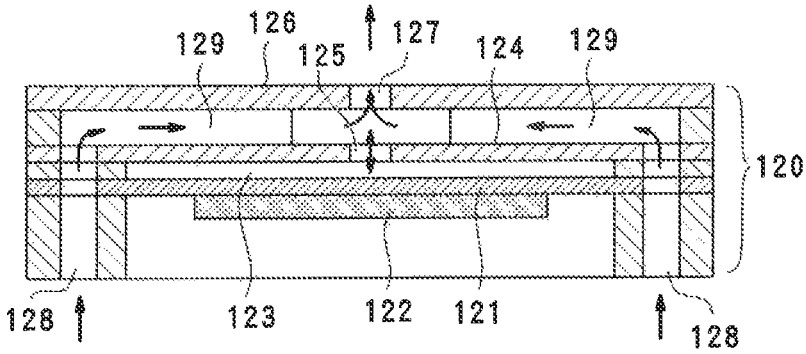
FIG. 16 PRIOR ART
FIG. 16 is a cross-sectional view of a micro-blower disclosed in International Publication No. WO2008/69266.

FIG. 9 shows a second preferred embodiment of the piezoelectric micro-blower according to the present invention. In the micro-blower B, a cylindrical nozzle 56 is arranged on the top plate (second wall portion) 51 so as to surround the entirety of the second opening 52. In a preferred embodiment of the present invention, as shown in FIG. 13B, the flow speed of air discharged from each hole of the second opening 52 is low as compared to the flow speed of air discharged from a single hole. Air discharged from the holes 52*b* arranged in the outer peripheral portion may peripherally diffuse. Thus, by arranging the nozzle 56 on the top surface of the top plate 51 so as to surround the holes 52*b* arranged in the outer peripheral portion, flows of air discharged from the holes 52*a* and 52*b* are converged into one flow and diffusion of air flow can be prevented and suppressed. It should be noted that the shape of the nozzle 56 is not limited to a simple cylindrical shape and can be a tapered shape or a trumpet shape, for example.

Third Preferred Embodiment

Figure 10A:
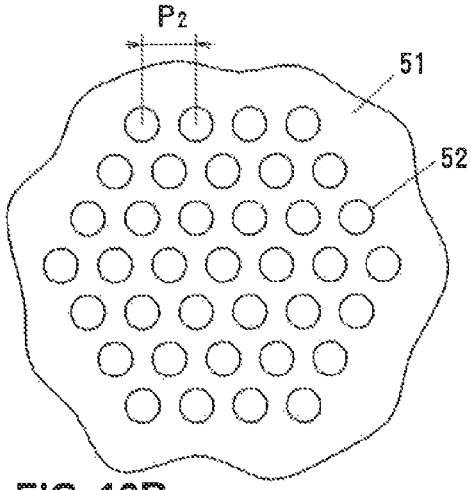
FIGS. 10A and 10B are diagrams showing a second opening and a first opening of a third preferred embodiment of the present invention.
Figure 10B:
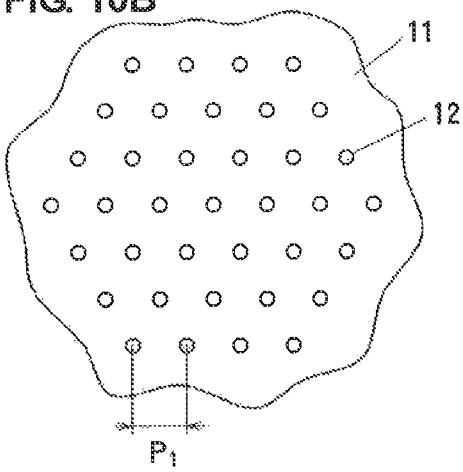

FIGS. 10A and 10B show a third preferred embodiment of the first opening 12 and the second opening 52. In this preferred embodiment, each of the first opening 12 and the second opening 52 preferably includes 37 small holes arranged in a hexagon, for example. Preferably, the diameter of each hole of the first opening 12 is ϕ about 0.1 mm, and the interval p1 is about 0.4 mm, for example. Similarly, preferably, the diameter of each hole of the second opening 52 is ϕ about 0.3 mm, and the interval p2 is about 0.4 mm, for example. The central axis of each hole of the first opening 12 and the central axis of each hole of the second opening 52 are aligned in a straight line. The other structure preferably is the same or substantially the same as that in the first preferably embodiment.

The advantageous effects achieved by each of the first opening 12 and the second opening 52 including 37 holes will be described in contrast to a comparative example 1. The comparative example 1 is the same as that described in the first preferred embodiment. In this case as well, the cross-sectional area (about 0.28 $mm^2$) of the first opening in the comparative example 1 and the total cross-sectional area (about 0.29 $mm^2$) of the first opening in the third preferred embodiment are set so as to be substantially the same.

Figure 11:
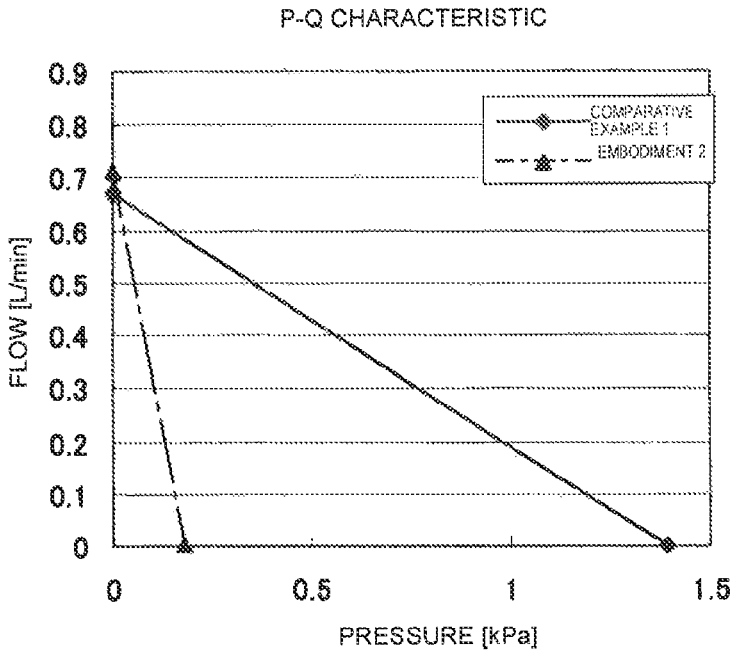
FIG. 11 is a P-Q characteristic diagram of the third preferred embodiment and a comparative example 1.

FIG. 11 shows each of P-Q (pressure-flow rate) characteristics of the third preferred embodiment of the present invention and the comparative example 1. The method of measuring the P-Q characteristic is the same as that in the first preferred embodiment. As is obvious from FIG. 11, it appears that in the third preferred embodiment, as compared to the comparative example 1, the pressure decreases to about ⅓ but the flow rate can be maintained to be substantially the same.

Figure 12:
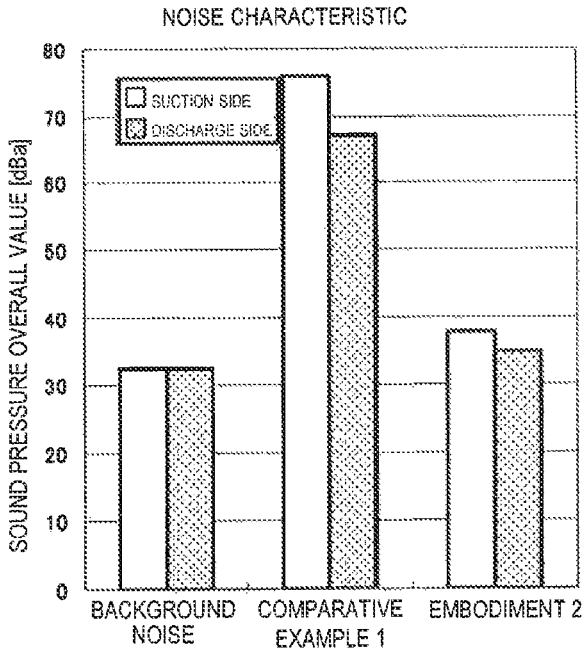
FIG. 12 is a diagram showing noise characteristics of the third preferred embodiment and the comparative example 1.

FIG. 12 shows noise characteristics of the third preferred embodiment of the present invention and the comparative example 1. The method of measuring the noise characteristic is the same as that in the first preferred embodiment. As is obvious from FIG. 12, it appears that in the third preferred embodiment, the noise significantly decreases on both the suction side and the discharge side as compared to the comparative example 1. Specifically, as compared to the comparative example 1, the noise decreases on the suction side by about 38 dB and on the discharge side by about 32 dB. In other words, it means that as compared to the comparative example 1, the sound pressure decreases to one-several hundredth. Meanwhile, the flow characteristic can be maintained to be substantially the same as that in the comparative example 1. Therefore, it appears that the noise can be reduced while the maximum flow rate is maintained.

The present invention is not limited to the preferred embodiments described above. For example, in the preferred embodiments described above, the example has been described in which the inner case and the outer case are configured preferably as separate members, the inner case is supported by the outer case through the spring connection portions, and transmission of vibrations of the inner case to the outer case is prevent and suppressed. However, the inner case and the outer case may be fixed to each other or may be integrally formed. In addition, each of the inner case 10 and the outer case 50 preferably has a structure in which a plurality of plate-shaped members is stacked, but is not limited thereto.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A piezoelectric micro-blower comprising:

a blower body;

a vibrating plate fixed at an outer peripheral portion thereof to the blower body and including a piezoelectric element;

a blower chamber located between the blower body and the vibrating plate;

a first wall portion of the blower body provided at a location facing the vibrating plate across the blower chamber to vibrate with vibrations of the vibrating plate;

a first opening located in the first wall portion;

a second wall portion located on an opposite side of the first wall portion with respect to the blower chamber;

a second opening located in a portion of the second wall portion which faces the first opening; and an inflow passage located between the first wall portion and the second wall portion;

wherein each of the first opening and the second opening includes a plurality of holes, and each hole of the first opening and each hole of the second opening are located at positions facing each other; and an area inside of each of the plurality of holes of the first opening and an area inside of each of the plurality of holes of the second opening at least partially overlap each other, when viewed in a direction from the second wall portion towards the first wall portion.

2. The piezoelectric micro-blower according to claim 1, wherein a central axis of each hole of the first opening and a central axis of each hole of the second opening coincide with each other.

3. The piezoelectric micro-blower according to claim 1, wherein a diameter of each hole of the second opening is about one to about three times that of a diameter of each hole of the first opening.

4. The piezoelectric micro-blower according to claim 1, wherein a cylindrical nozzle is arranged on an outer surface of the second wall portion so as to surround all the holes of the second opening.

* * * * *